United States Patent [19]

Schaaf et al.

[11] 4,312,600

[45] Jan. 26, 1982

[54] TRAFFIC BARRICADE

[76] Inventors: Cecil Schaaf; Craig Schaaf, both of 3015 Palmer Rd., Standish, Mich. 48658

[21] Appl. No.: 123,527

[22] Filed: Feb. 22, 1980

[51] Int. Cl.[3] ..... E01F 13/00; B63B 21/52

[52] U.S. Cl. ..... 404/6; 9/8 R; 40/612; 116/63 P; 116/107; 256/13.1; 404/9

[58] Field of Search ..... 404/6, 9; 256/1, 13.1, 256/64; 116/63 P, 107; 40/606, 612; 248/469, 346; 9/8 R

[56] References Cited

U.S. PATENT DOCUMENTS

| | | | |
|---|---|---|---|
| 2,814,055 | 11/1957 | Phillips | 9/8 R |
| 2,887,983 | 5/1959 | Budd | 116/63 P |
| 3,728,749 | 4/1973 | Eby et al. | 9/8 R |
| 3,994,478 | 11/1976 | Specht | 256/1 X |
| 4,183,695 | 1/1980 | Wilcox | 404/6 |

FOREIGN PATENT DOCUMENTS

| | | | |
|---|---|---|---|
| 1534568 | 6/1969 | Fed. Rep. of Germany | 256/64 |
| 1921005 | 11/1969 | Fed. Rep. of Germany | 256/64 |
| 1184406 | 7/1959 | France | 116/63 P |

*Primary Examiner*—Rodney H. Bonck
*Attorney, Agent, or Firm*—Cullen, Sloman, Cantor, Grauer, Scott & Rutherford

[57] ABSTRACT

A traffic barricade or marker comprises a base in the form of a conventional pneumatic vehicle tire having a pair of substantially vertical flexible plastic tubular posts upstanding from the tire upper sidewall from aperture means located diametrically across from each other. The tubular posts in their unflexed condition are substatntially straight and upwardly diverging in a symmetrical manner away from the tire principal axis. A substantially rectangular structural member has a pair of longitudinally spaced tubular-like connector formations thereon of a size to be freely telescoped over the upper end portions of said posts. The structural member has a predetermined major dimension between its connector formations so as to continually flex the upper end portions of the posts into substantial parallel relation whereby said connector formations are releasably retained on the posts. As a result, each of the lower end portions of the posts are urged into contact with an edge of its associated tire aperture means to frictionally retain the posts within the tire. The structural members may be either flexible banners or figid rail members while the tire may be filled with buoyant material for use in the invention as a floatable marine traffic marker or buoy. A further disclosed alternative uses wood boards as the base with the banners flexing the posts toward each other and a rigid top rail forcing their upper ends apart.

26 Claims, 9 Drawing Figures

TRAFFIC BARRICADE

BACKGROUND AND SUMMARY OF THE INVENTION

This invention relates to traffic barricades or markers used, for example, as barriers or barricades on construction sites or roadways during construction to channelize pedestrian or vehicular traffic. Another application for the traffic marker of the present invention is as a floatable buoy for use in marking a selected location on the surface of a body of water.

Various forms of traffic markers have been used to indicate or warn approaching pedestrians or vehicles of holes or other dangerous obstructions. A major objection to hinged at the top foldable markers, made of metal legs and wooden cross bars, is that they represent a solid obstacle in the event that they are hit by a vehicle. Further, hinged type barriers, by virtue of their high center of gravity, are often required to be weighted with stabilizing sand bags laid across their lower cross bars and obscuring the striped or reflective display portions thereon. If the bags are suspended like a pendulum to avoid becoming frozen to the pavement during winter, they divide the legs such that if the barriers are blown over or knocked over by a vehicle the metal legs may project upwardly at acute angles to extensively damage a vehicle. The high center of gravity could cause a hinged barrier to be thrown on the hood of an impacting vehicle causing broken windshields and injury to the occupants.

The present invention provides a traffic marker which is extremely safe to an impacting vehicle in that its structural components include a conventional pneumatic vehicle tire base, a pair of upstanding hollow plastic posts and one or more cross bars in the form of flexible display banners or rails that also serve as structural supports holding the posts in a flexed, readily releasable, upstanding position on the tire. A low center of gravity is attained by the present invention in that the relatively heavy tire base comprises the overwhelming portion of the marker weight while extending vertically less than one-quarter of the total marker height.

The alternative wood base constructiion provides a lower profile base, to further reduce damage to an impacting vehicle, while achieving a broad and stable base.

Another advantage of the present invention is that the structural cross members are in substantially vertical planes such that the display surface thereon reflects the rays from vehicle lights in a manner that they are returned directly to the vehicle. Still another advantage of the instant invention is the marker is not vulnerable to corrosion in that it has no metal parts in certain forms of the invention and minimal metal parts in the remaining embodiments.

A further advantage of the present invention is that reflective pressure sensitive tape displaying warning indicia, such as reflective diagonal stripes, may be used on the structural cross members with the cross members being readily removed or interchanged by one person without the use of any tools to have the stripes slant downwardly to the right or left to direct traffic in the desired direction. As the expensive reflective material is easily damaged, such as in transit, applicant's cross members are easily removed and stored in a protected manner to prevent damage to their reflective surfaces.

BRIEF DESCRIPTION OF THE DRAWINGS

The foregoing objects and advantages of the present invention, together with the objects and advantages which may be attained by its use, will become more apparent upon reading the following detailed description taken in conjunction with the drawings.

In the drawings, wherein like reference numerals identify like or corresponding parts.

DETAILED DESCRIPTION OF THE DISCLOSURE

Figure 1:
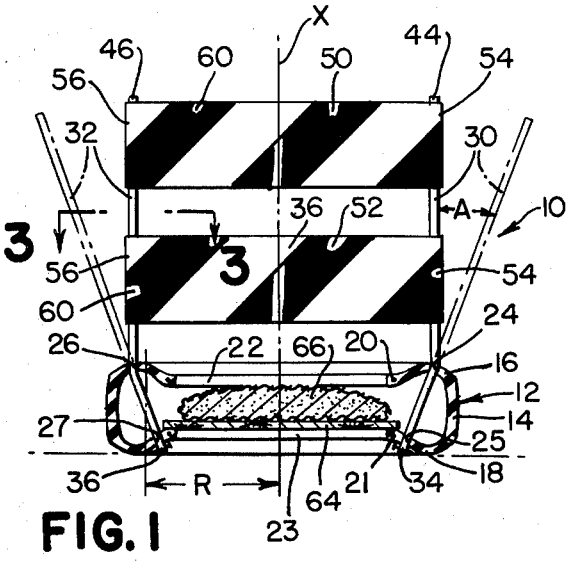
FIG. 1 is an elevational view of one form of the present invention showing a barrier-type marker partially in section to show details thereof.
Figure 2:
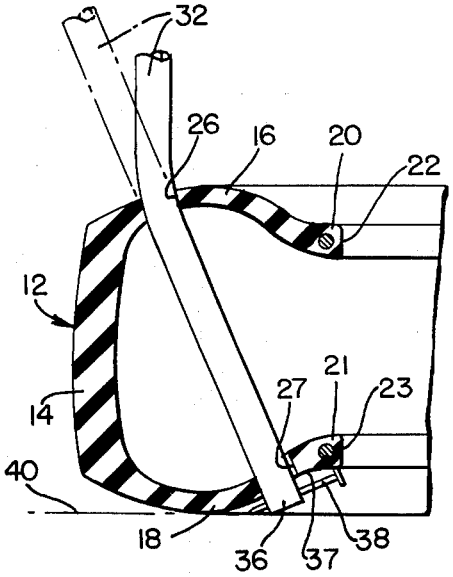
FIG. 2 is an enlarged vertical sectional view of the base portion of the marker of FIG. 1.
Figure 3:
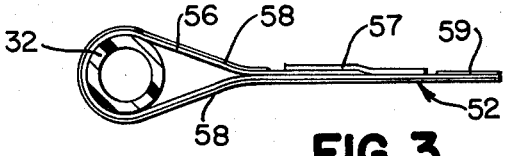
FIG. 3 is an enlarged vertical sectional view of the connector portion taken substantially on line 3—3 of FIG. 1.

Referring to the drawings, a first embodiment of the present invention is shown in FIGS. 1, 2 and 3 wherein a traffic marker, generally indicated at 10, basically comprises a base portion in the form of a conventional pneumatic vehicle tire 12 having a tread portion 14, a pair of upper and lower sidewall portions 16 and 18 respectively, and a pair of upper and lower bead portions 20 and 21 respectively, defining upper 22 and lower 23 central tire openings. As best seen in FIG. 2 the cross-section of the tire 12 is taken on a vertical diametrical plane wherein first and second aperture means are shown located diametrically across from each other. In the disclosed form the aperture means are shown as first and second pairs of apertures symmetrical with the tire vertical principal axis "X" in the vertical section plane. The first or right-hand pair of apertures, indicated at 24 and 25 in FIG. 1, are shown with the upper aperture 24 being located in the upper sidewall 16 near its radially outward portion so as to be adjacent to its juncture with the tread portion 14 thereof. The lower right-hand aperture 25 is located in the tire lower sidewall at a radial location adjacent its juncture with the lower bead portion 21 thereof. In a similar manner, the second or left-hand pair of apertures, indicated at 26 and 27 in FIGS. 1 and 2, with the upper left hand aperture 26 located in the tire upper sidewall 16 near its radially outward portion so as to be adjacent to its juncture with the tread portion 14. The lower aperture 27 of this second pair of apertures is located in the lower sidewall 18 adjacent the lower bead portion 21.

A pair of generally straight flexible plastic tubular post members are supported on the base or tire 12 such that the first post member 30 lower end portion is received in one of said pair of aperture means and the second post member is received in the remaining aperture means. The post 30 extends through the first pair of upper and lower apertures 24 and 25 and the second post member 32 extends through the second pair of upper and lower apertures 26 and 27. As best seen in FIG. 2, the post members 30 and 32 have their lower ends 34 and 36 extending through and beyond the lower apertures 25 and 27 respectively, a sufficient distance such that transverse securing or locking means may be provided to positively prevent the withdrawal of the posts. In the disclosed embodiment there is shown optional locking means in the form of a common nail or spike 38. The spike extends through a pair of aligned apertures at the lower ends of the posts with the post apertures being of a size to allow the spike to be easily inserted and removed.

While the paired sidewall apertures 24, 25 and 26, 27 are preferably located as shown in FIG. 2 for paired apertures 26 and 27 it will be appreciated that the apertures could be positioned closer to or further away from the tire mean radius, indicated at "R" in FIG. 1. Thus, the paired apertures 26 and 27 may be located over a range of locations within the limitation that the aperture 26 in the tire upper sidewall portion 16 being located radially outwardly from the mean radius "R" of the tire while the aperture 27 in the tire lower sidewall portion 18 being located radially inwardly from the mean radius "R".

The flexed position of the assembled posts induces a radially inward pressure of each post against its associated upper sidewall aperture and a radially outward pressure against its associated lower sidewall aperture. The pressure at these contact points creates a frictional gripping force which resists removal of the flexed posts in normal conditions. In an alternate barricade form of the invention to be discussed, however, the locking pins or spikes 38 may be required to permit the barricade to be easily lifted and moved by one person grasping a post in either hand. Thus, in the case of a barricade employing a heavier truck tire as the base and rigid cross rails, the optional locking pins 38 provide positive retention of the post 32.

As the manner in which the upright posts 30 and 32 are releasably retained in combination with the marker's superstructure in composite unity with the tire is identical in all respects, the discussion relative to the post 32 of FIG. 2 applies equally to the post 30. The posts 30 and 32 are shown in FIG. 1 in dotted lines wherein the posts lower end portions have been inserted in their associated aperture means 24, 25 and 26, 27, respectively, the arrangement being such that they are located in a substantially vertical plane including the tire axis "X" and normal to the horizontal plane of symmetry of the tire. The posts 30 and 32 are in the form of flexible plastic individual tubular posts of uniform circular cross-section along their entire length and are of a diameter adapted to be slidably received in their associated paired tire apertures 24,25 and 26,27. In the embodiment of FIGS. 1–3 the posts are about three feet in length and have an internal diameter of about three-fourths of an inch. The posts are made from a suitable plastic material which in the disclosed form is polyvinylchloride (PVC) plastic material with the posts being available from plastic manufactures. One source of posts is sold under the trade name of Genova Hi-Temp water pipe having a manufacturer designation $\frac{3}{4}$ inch CPVC 4110.

By virtue of the above-described arrangement the posts 30 and 32 are flexed or urged inwardly from their dashed line positions to their vertical upstanding solid line position shown in FIG. 1 with the posts substantially parallel to each other. In this upstanding position the posts 30 and 32 are adapted to receive over their upper ends 44 and 46 respectively, barrier superstructure comprising one or more cross structural members. The cross structural members for the traffic marker of FIGS. 1–3 comprise a pair of upper and lower substantially rectangular flexible banners, indicated generally at 50 and 52, and shown operatively attached and extending between the upright posts. As the banners 50 and 52 are identical in all respects only the banner 52 will be described in detail with the same reference numerals indicating like or corresponding parts for banner 50.

The flexible banner 52 is generally rectangular and is provided with laterally spaced tubular-like connector formations releasably retaining the banner to the posts. The banner connector formations indicated at 54 and 56, are in the form of hem-like loops as seen by the left hand connector loop 56 in FIG. 3. The loops are formed by reverse folding the flexible banner back on itself to define the loop connector formation of a suitable size to be freely telescopically received over the upper end 46 of post 32. It will be noted in FIG. 3 that the banner loop free side edge 57 overlaps a portion of banner planer display area in flush relation and is suitably secured thereto such as by adhesive tape shown at 58. Other securing means could be used to form the end loops 56 such as by being stitched, glued, or stapled, etc.

While it is contemplated that the flexible banners 50, 52 could be made from various flexible material, in the disclosed form, the banners are a relatively heavy weight spunbonded olefin plastic fabric sold under the trademark Tyvek and manufactured by DuPont as Style 1085D. In the preferred embodiment the banners are in the form of a laminate with the outer surfaces covered by reflective pressure sensitive tape 58 and 59 displaying suitable indicia such as alternating diagonal orange and white stripes generally indicated at 60. One form of the indicia tape is manufactured by the 3M Company, with reflective beads on a plastic film backing with the tape having an adhesive of the peel-off type. As such tape is comparatively expensive, applicant's arrangement of readily detachable flexible laminate banners allows them to be removed and separately stored during transit to prevent damage.

The banner loops 54 and 56 are of a size, together with the diametrical spacing of the posts, to enable one workman to partially slide or telescope one loop, such as loop 56 for example, over the upper end 46 of the outwardly diverging post 32. Next the workman grasps each of the posts and deforms or flexes the posts into an upright position. The banner is next flexed upwardly to allow the remaining loop 54 to be readily telescoped over the upper end 44 of the remaining post 30. Thus, with each post having its upper end portion received in its associated banner loop 54, 56 release of the posts longitudinally tensions the banner by virtue of an outward pull on each of the connector means or loops. The flexible banner holds the posts in substantial parallel relation because the longitudinal dimension between the center of curvature of loops 54 and 56, is substantially equal to the diametrical dimension between the centers of the tire sidewall upper apertures 24 and 26.

As seen in FIG. 2 the retention of posts upper portions in parallelism maintains longitudinal tensioned pull on the flexible banner 50 causing the lower portions of the posts 32 to be bowed concavely inwardly into snug contact with the radially inner edge portion of aperture 26 and the radially outer edge portion of aperture 27. Because of the flexible nature of the tire upper and lower sidewalls it will be appreciated that the paired apertures 24, 25 and 26, 27 may be oversize in diameter relative to the outer diameter of the posts thereby allowing ready initial insertion of the unflexed straight posts therein. The flexibility of the tire sidewalls allows the posts 30 and 32 to be originally oriented at a predetermined angle "A" which in the disclosed form is of the order of about 20 to 30 degrees from the vertical within the resultant flexure of the posts through the angle "A" insuring snug retention of the lower post portions by the tire apertures.

By virtue of the relatively heavy tire base it will be understood that a stable low center of gravity marker or barrier 10 is attained. To provide additional support for the tire base, however, the marker 10 of the present invention is adapted to receive a ballast support platform in the form of a wood plank 64 that may be inserted in the tire central opening 22 so as to be loosely supported on the lower bead 21 by deflection of the tire sidewalls. The plank 64 is substantially centered on a diametrical axis of the tire, offset from the diametrical axis of the posts, so to be captured between the sidewalls 16 and 18 to insure against inadvertent removal. The wood plank 64 in FIG. 1 supports suitable ballast such as a sand bag 66 thereon with the sand bag located sufficient distance above the road way to insure against its freezing thereon. The bag is nested within the tire opening 24 to prevent its obstructing any part of the display banners and their warning indicia.

Figure 4:
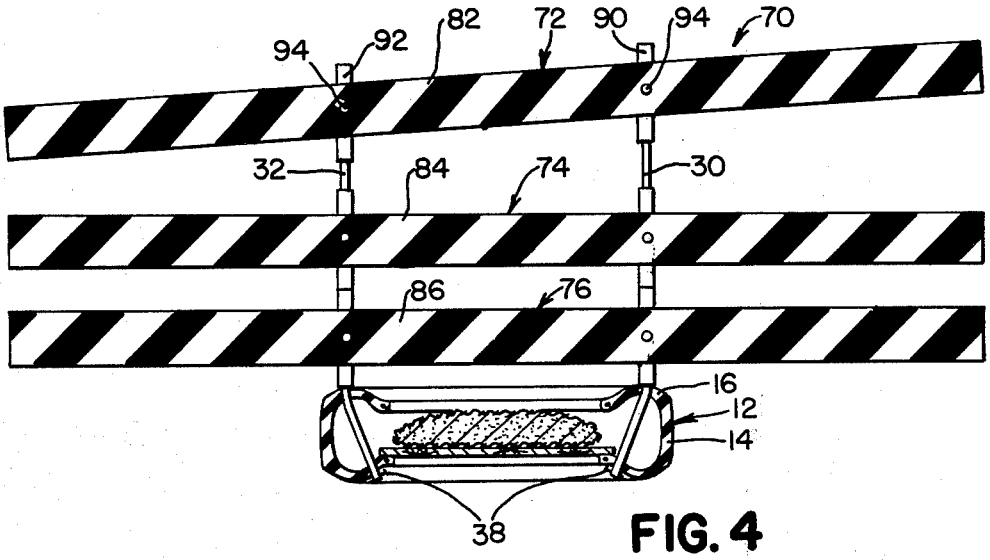
FIG. 4 is an elevational view partially in section, of a partially assembled marker of the present invention disclosing an alternate barricade-type marker form of the invention.
Figure 5:
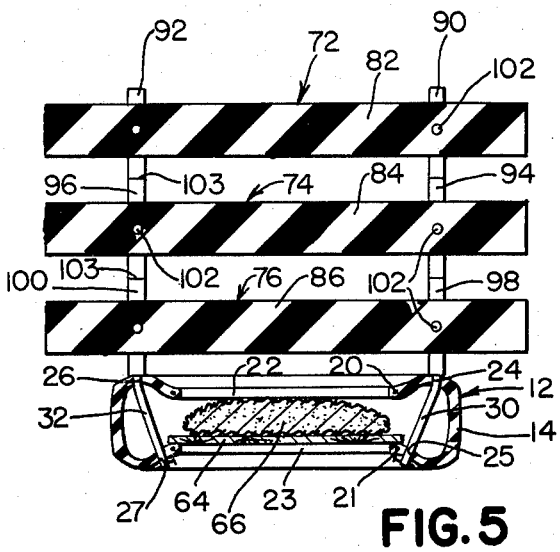
FIG. 5 is a view similar to FIG. 4 showing the barricade in its fully assembled form.
Figure 6:
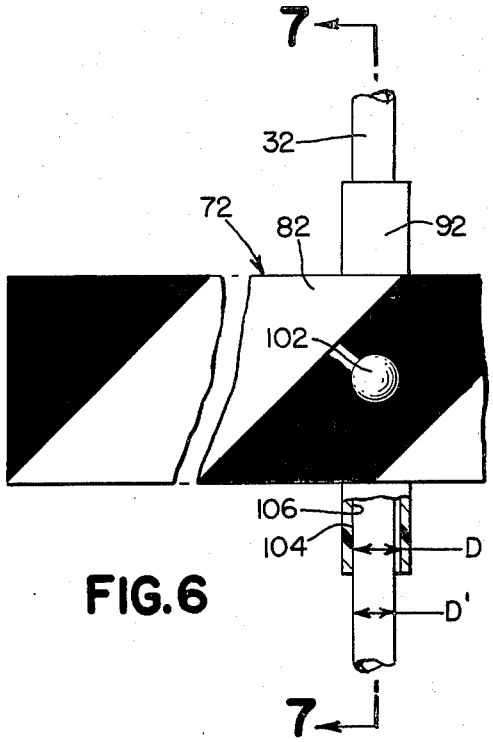
FIG. 6 is an enlarged fragmentary elevational view of the connector portion with parts broken away to show details thereof.
Figure 7:
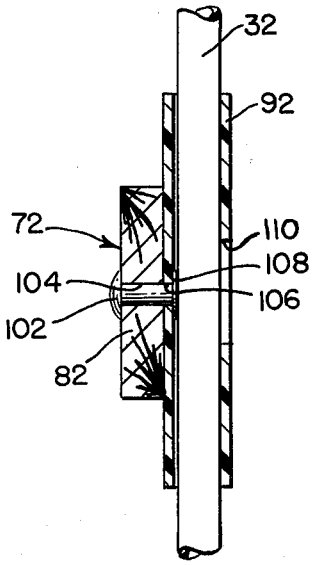
FIG. 7 is a vertical sectional view taken on line 7—7 of FIG. 6.

Turning now to the modified form of the invention shown in FIGS. 4, 5, 6 and 7, wherein like reference numerals represent like or corresponding parts. It will be seen in FIG. 10 that a traffic marker or barricade, generally indicated at 70, is shown including a base or tire 12 and a pair of upstanding posts 30 and 32 identical to the tire and post set forth in the marker or barrier of FIGS. 1, 2 and 3. In FIG. 4, the barricade superstructure is shown in the form of one or more substantially rectangular structural members shown as cross-bar or cross rail assemblies, generally indicated at 72, 74 and 76, which are identical. In the disclosed form, the cross-rail assemblies 72, 74 and 76 each include cross-bar or rail 82, 84 and 86 respectively, having a longitudinal dimension of about eight feet and a width of about ten inches to conform with Federal Highway specifications. As best seen in FIGS. 6 and 7, each structural member or cross-bar assembly 72 includes a pair of longitudinally spaced vertically extending tubular-like connector formations or tubes shown at 90 and 92 for the cross bar assembly 72, at 94 and 96 for assembly 74 and 98 and 100 for assembly 76.

As seen in FIGS. 6 and 7 each of tubes 90 and 92 is pivotally secured to cross bar 82 by means of a pivot bolt 102 extending through an aligned aperture 104 in the cross bar 82 and aligned with aperture 106 in the connector tube 92. The connector tube 92 has an internal diameter "D" of about 2 inches in the disclosed form, to receive an upright post therethrough such as post 32 shown therein. In the form shown the post 32 has an outer diameter "D'" of about $1\frac{1}{4}$ inch such that the connector tube has sufficient clearance with the post 32 to clear the pivot bolt inner head 108.

As seen in FIG. 7 the connector tubes are formed with an access aperture or hole means 110 aligned on the axis of the apertures 104 and 106 thereby to allow ready securing of the pivot bolts 102. It should be pointed out that the marker barricade 70, because of its greater overall height of about five feet in the form shown, together with the additional weight of its rigid cross bar assemblies, will have a higher center of gravity than the marker barrier form of the invention shown at 10. To compensate for its higher center of gravity, a heavier truck tire may be employed with the marker barricade 70.

With regard to the assembly of the barricade 70, it will be appreciated that with the use of rigid cross bar or rail members 82, 84 and 86 that ordinarily the upstanding posts 30 and 32 would be required to be maintained in a substantially vertical relationship to enable the cross bar tubular connectors 90 and 92 to be telescoped over the upper ends of the posts. Such a procedure would require at least two men to assemble the barricade 70 with the two-man crew being a costly additional labor charge to the contractor. However, by means of applicant's novel use of pivotally mounted tubular connectors, such as 92, having a single pivot bolt 102, the connectors can maintain parallel motion in a vertical direction for telescopic assembly over the posts even though the cross bar or rail may not be horizontal at all times during such assembly. Thus, the barricade 70 can be assembled by a single workman wherein the first tubular connector 92 is partially telescoped over the upper end 46 of post 32. Next the rail 82 is pivoted or raised to the position shown in FIG. 4 allowing the other post 30 to be bowed into an upright position in substantial parallelism with the post 32 for straight-line reception of the tubular connector 90 on post 32 after which the cross bar assembly can be readily lowered on the posts to the position shown at FIG. 5. It will be seen that each cross bar assembly is located on the posts in the same manner. In the completed barricade of FIG. 5 the tubular members 90, 92 and 94 of the cross bar assemblies 72, 74 and 76 are in vertical lined abutment at their junctures, indicated for example at junctures 103 in FIG. 5. It will be noted that each tubular connector extends beyond the upper and lower longitudinal edges of its associated rail 82 so that upon abutting with the next adjacent connector proper spacing is provided between each of the rails to conform with highway specifications. As in the case with the first form of the invention when the upper ends of the posts 30 and 32 are flexed or tensioned laterally into parallelism, the cross bar assemblies urge the posts into substantial parallel relation. As seen in FIG. 6, the continual flexing of the posts results in the outer curved portion 104 of the posts 32 to be biased or urged into contact with the mating inner curved surface portion 106 of connector 92 to retain the cross bar assemblies in a secure manner and to prevent inadvertent removal thereof.

Again suitable warning indicia or the like is provided on the surface of the rails which in the disclosed form could be diagonal stripes, alternating orange and white, in the same manner as the marker of FIGS. 1–3.

Another advantage of applicant's invention is that government highway specifications require that the diagonal stripes be either sloped downwardly toward the left as shown in FIG. 1 to signal to the on-coming traffic that they should pass to the left of the barricade or alternatively, with the diagonal stripes oriented downwardly to the right and traffic required to pass on the right side of the barricade. It will be appreciated that such requirement requires that a contractor should have available two types of barricades depending on where they are located at a construction sight. With Applicant's readily disassembled and assembled markers and barricades, however, it will be seen that the flexible banners for the barrier markers of FIG. 1 through 3 or the cross bar assemblies for the barricade markers of FIGS. 4–7 can be readily interchanged by one workman.

Figure 8:
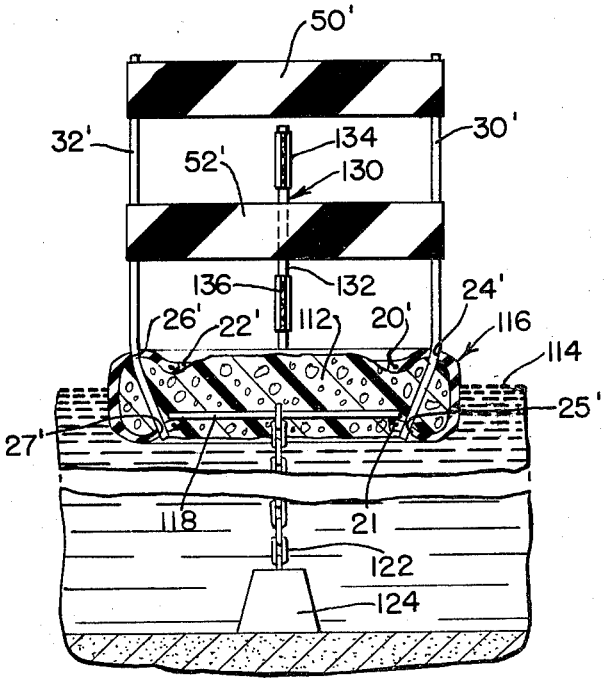
FIG. 8 is an elevational view, partially in section, of still another alternate form of the marker of the present invention for use as a marine buoy-type marker.

A third form of the invention is disclosed in FIG. 8 wherein a marker 110 is shown having its base tire filled with a suitable foam material such as polyurethane foam, indicated at 112 to provide a floatation marker or marker buoy for marking a selected location on the surface of a body of water 114. The foam-filled tire generally indicated at 116 includes a suitable cross member or transverse reinforcing bar 118 which is shown supported on the lower bead portions 21' during the foaming process. Further, a floatation chain indicated at 122, is attached to the marker by suitable means such as by having an upper link slidably receiving the support bar 118 with the flexible chain retained on the vertical center line of the tire by the foamed-in-place operation. The anchor line or chain 122 is shown provided with a suitable anchor or weight 124 operative to sink in the body of water 114 and rest on the bottom and anchor the marker in a conventional manner.

In the marker buoy of FIG. 8, a single superstructure may be used which is identical to the posts and banner of FIG. 1, with the identical posts indicated by like primed numerals. It will be noted, however, that a second cross superstructure member may be provided, shown at 130, including a pair of upright tubular posts, one of which is shown at 132. Such member 130 is provided with identical post receiving tire aperture means or paired apertures 24', 25', 26' and 27' located on a diametrical axis of the tire preferably at right angles to the diametrical axis of the posts 30' and 32'. The second vertical marker 130 includes flexible banners, shown at 134 and 136, which are in all respects identical to the banners 50' and 52' and the lower banner 136 extending between the lower banner 52' and the foam-filled tire 116. By virtue of this crossed superstructure arrangement, it will be appreciated that the marker 110 can be seen at all angles by approaching marine traffic even though the tire 116 is undergoing rotational movement by the water currents acting thereon.

Figure 9:
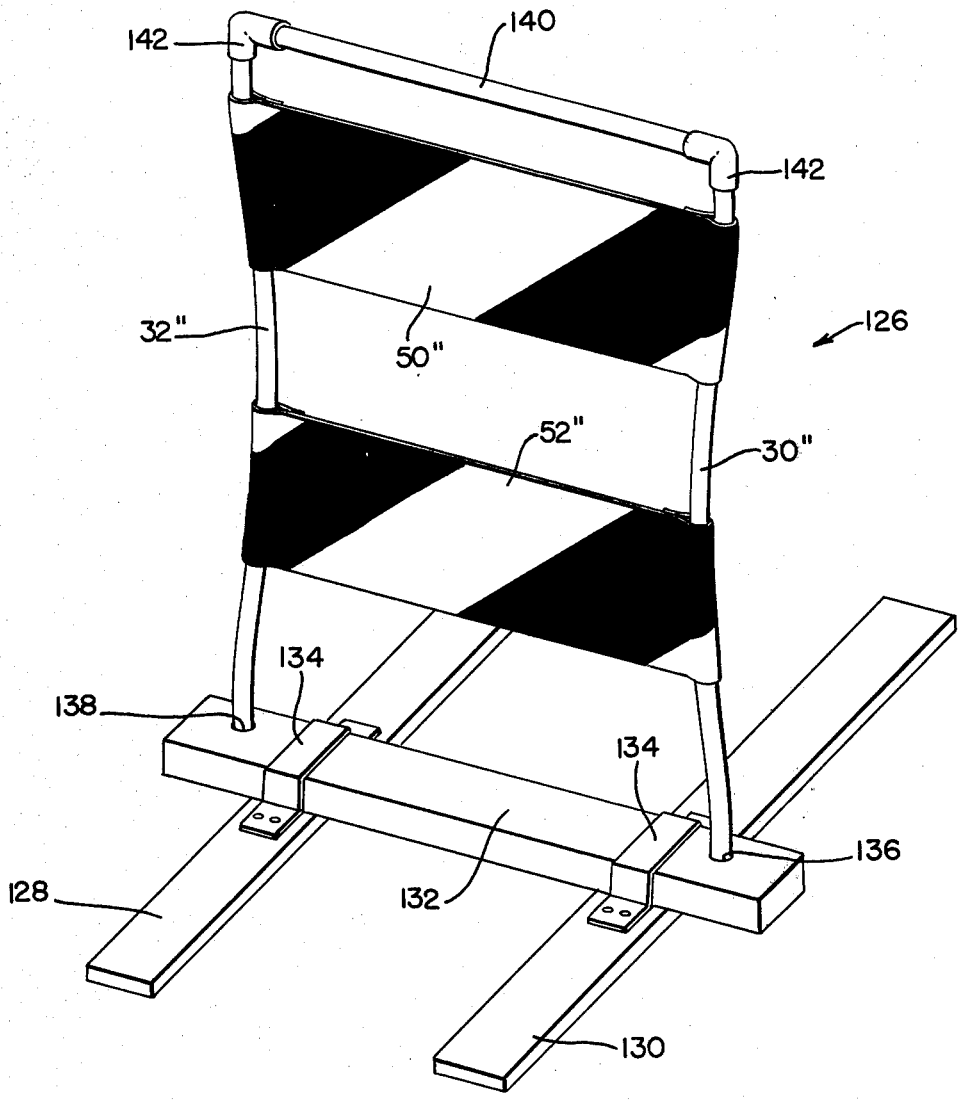
FIG. 9 is a perspective view of a further alternate form of the invention.

FIG. 9 illustrates a still further alternate form of the invention, utilizing wood boards as the base in place of the tire of the above-described embodiments. The disclosed wooden base not only provides a stable but lighter weight and more compact base, and also serves as a readily available alternative in the event of the unavailability of used tires of adequate diameter to support the customary 24-inch minimum width barricade. The current trend toward smaller cars has been accompanied by the use of smaller tires, typically having a diameter of only 23 inches.

The modified barricade 126 of FIG. 9 employs a pair of wooden base stabilizers 128, 130 interconnected by a wooden cross member 132 which can be removably or permanently connected to the stabilizer members. In the disclosed embodiment, cross member 132 is simply slid through a pair of brackets 134 secured to the stabilizer members, with cross member 132 being retained in position by the fact that plastic posts 30'', 32'' prevent the ends of cross member 132 from passing through brackets 134. The selection of the size of the three wooden base members is a matter of choice, depending upon cost, desired weight and stability and so forth. Typically, stabilizer members 128, 130 may be 1×4 or 2×4, while cross member 132 may be 2×4 or 2×8.

As illustrated in FIG. 9, brackets 134 are not mounted at the mid point of the length of stabilizer members 128, 130, resulting in a greater length of the stabilizer members being behind the upstanding portion of marker 126. This optional feature provides greater stability against overturning wind forces blowing in the direction toward the rear of the marker, such as would be induced by the draft of passing large vehicles.

Posts 30'' and 32'' are received in holes 136, 138, respectively of cross member 132. The lateral dimension between holes 136, 138 is preferably slightly wider than the lateral width of banners 50'', 52'', so that the assembled banners will resiliently flex the posts inwardly in an upwardly converging manner to establish the snug frictional retention of the posts within holes 136, 138 as described with respect to the other embodiments of this invention.

A third piece of plastic tubing is utilized as upper cross member 140, which is connected to the upper ends of the posts by means of standard plastic elbows 142. Preferably, the length of upper cross member 140 is selected so that the lateral distance between the downwardly extending legs of elbows 142 is again greater than the lateral width of banners 50'', 52'', so that the assembly of upper cross member 140 to the posts will cause the upper portion of the posts to diverge upwardly. Thus, the complete assembly as shown in FIG. 9 results in the two banners flexing or pulling both posts inwardly from their upper and lower anchorage points in elbows 142 and holes 136, 138. The resilient flexing of such posts provides the desired frictional gripping of the co-acting elements which results in the retention of banners 50'', 52'' in their desired position along the posts and also in the retention of upper cross member 140 and elbows 142 on the posts.

As will be understood by those skilled in the art, holes 136, 138 can be drilled along substantially vertical axes through base cross member 132 or can be oriented so that they converge upwardly. As long as upper cross member 140 is long enough, and banners 50'', 52'' short enough, the above-described coaction of the parts will be achieved.

In assembling and disassembling the marker of FIG. 9, it will be understood that the banner portions can be telescopically applied to or removed from either end of the posts. However, it will be appreciated that it is not really necessary to completely disassemble the upstanding portion of the marker for storage, because it can be compactly stored simply by removing the posts from base cross member 132 and then sliding cross member 132 out from within brackets 134.

Accordingly, there has been disclosed an improved traffic marker system which is relatively inexpensive, can be readily assembled and disassembled for transporting and storage, is extremely stable due to its low center of gravity and resilient yieldability in high wind forces, and causes less damage and hazard in the event of collision by a vehicle.

This invention may be further developed within the scope of the following claims. Accordingly, the above specification is to be interpreted as illustrative of only four operative embodiments, rather than in a strictly limited sense.

We now claim:

1. A traffic marker comprising:

a relatively heavy base in the form of a horizontally disposed vehicle tire including upper and lower sidewall portions, said upper sidewall portion having a pair of aperture means therein located diametrically across from each other;

a pair of substanially vertical, flexible plastic tubular posts upstanding from said tire upper sidewall portion with the lower end portion of each post being received in one of said aperture means;

said pair of posts in their unflexed condition being substantially straight and upwardly diverging away from the principal axis of said tire in a substantially symmetrical manner;

a cross structural member having a pair of laterally spaced vertically extending tubular-like connector formations thereon, each said connector formation telescoped over a portion of an associated one of said posts such that said cross structural member extends between said posts above said base;

said cross structural member having a predetermined major dimension between its connector formations such that said member continually flexes the free upper end portions of said posts inwardly into substantial parallelism whereby said connector formations are frictionally retained on said posts; and the arrangement being such that the lower end portions of said posts are bowed concavely inwardly whereby each said post lower end portion is urged into snug retention in its associated aperture means.

2. The traffic marker as defined in claim 1, wherein each said aperture means in said tire upper sidewall portion is located radially outwardly from the mean radius of the tire, and said tire including a second pair of aperture means in said tire lower sidewall portion located radially inwardly from the mean radius of the tire.

3. The traffic marker as defined in claim 1, wherein each said aperture means in said tire upper sidewall portion is located adjacent the juncture of the tire tread portion with the tire sidewall portion, and said tire includes a second pair of aperture means in said tire lower sidewall portion located adjacent the juncture of the tire bead portion with the tire sidewall portion.

4. The traffic marker as defined in claim 1, wherein locking means are provided adjacent the lower end of each said post to lock said posts in their associated aperture means.

5. The traffic marker as defined in claim 1, wherein at least two vertically spaced cross structural members are provided between said posts.

6. The traffic marker as defined in claim 1, wherein platform means are supported on said tire lower bead portion for receiving ballast means thereon, such that said ballast means is spaced above the marker supporting surface.

7. The traffic marker of claim 1 wherein said tire is filled with bouyant material operative to float said marker on the surface of a body of water.

8. The floatable marine traffic marker as defined in claim 7 wherein said upper sidewall portions have two pair of aperture means therein located diametrically across from each other;

two pair of substantially vertical flexible plastic tubular posts upstanding from said tire upper sidewall portion with the lower ends of each pair of posts being received in one of said pair of aperture means;

each said pair of posts substantially symmetrical about the principal axis of said tire, each pair of posts in their unflexed condition being substantially straight and upwardly diverging away from said tire axis in first and second vertical intersecting planes common to said tire axis;

each said pair of posts including a substantially rectangular flexible banner structural member, having laterally spaced transversely extending tubular-like connector formations thereon, each said connector formation telescoped over a portion of one of its associated pair of said posts such that each said flexible banner extends between its associated pair of posts, and whereby the flexible banner on said one pair of posts is located vertically above the flexible banner on said remaining pair of posts;

said flexible banner structural member having a predetermined major dimension between its associated connector formations whereby each said banner continually flexes the free upper end portions of its associated pair of posts into substantial parallelism whereby each banner connector formation is retained on its associated pair of posts;

the arrangement being such that the lower end portions of each said pair of posts are bowed concavely inwardly whereby each said pair of posts lower end portions are urged into snug retention in their associated pair of aperture means.

9. The floatable marine traffic marker as defined in claim 8 wherein at least two vertically spaced flexible banners are provided between the posts of each of said post pairs.

10. The floatable traffic marker as defined in claim 7, wherein a cross structural member is retained within said tire by the bouyant material operative for connection with anchor securing means located so as to extend vertically downwardly from the marker.

11. A traffic marker comprising:

a relatively heavy base in the form of a horizontally disposed vehicle tire including upper and lower sidewall portions, said upper sidewall portions having a pair of aperture means therein located diametrically across from each other and radially outwardly from the mean radius of the tire, and said lower sidewall portions having a second pair of aperture means located diametrically across from each other and radially inwardly from the mean radius of the tire, all four of said aperture means being substantially coplanar;

a pair of substantially vertical flexible plastic tubular posts upstanding from said tire upper sidewall portion with the lower end of each post being received in one of said upper sidewall aperture means and one of said lower sidewall means;

said pair of posts in their unflexed condition being substantially straight and upwardly diverging away from the principal axis of said tire in a substantially symmetrical manner;

a flexible banner having laterally spaced transversely extending tubular-like connector formations thereon, each said connector formation telescoped over a portion of an associated one of said posts such that said flexible banner extends between said posts above said base;

said flexible banner having a predetermined major dimension between its connector formations such that said banner continually flexes the free upper end portions of said posts into substantial parallelism whereby said connector formations are frictionally retained on said posts; and the arrangement being such that the lower end portions of said posts are bowed concavely inwardly whereby each said post lower end portion is urged into snug retention in its associated aperture means.

12. The traffic marker of claim 11 wherein said tire is filled with bouyant material operative to float said marker on the surface of a body of water.

13. The floatable traffic marker of claim 12 wherein a cross structural member is retained within said tire by the bouyant material operative for connection with anchor securing means located so as to extend vertically downwardly from the marker.

14. The traffic marker as defined in claim 11, wherein each said connector formation is a hem-like loop formed at each end of the banner.

15. The traffic marker as defined in claim 11, wherein at least two vertically spaced flexible banners are provided between said posts.

16. A traffic marker comprising:

a relatively heavy base in the form of a horizontally disposed vehicle tire including upper and lower sidewall portions, said upper sidewall portion having a pair of aperture means therein located diametrically across from each other;

a pair of substantially vertical, flexible plastic tubular posts upstanding from said tire upper sidewall portion with the lower end portion of each post being received in one of said aperture means;

said pair of posts being substantially symmetrical about the principal axis of said tire, said posts in their normal unflexed condition being substantially straight and upwardly diverging away from said tire axis;

a substantially rigid cross-rail member having a pair of laterally spaced vertically extending tubular connector portions pivotally connected thereon, each said tubular connector portion operative to pivot about a horizontal axis perpendicular to said rail member, each said connector portion telescoped over a portion of an associated one of said posts such that said cross-rail member extends between said posts above said base;

the orientation and lateral spacing between said aperture means being selected to coact with the orientation and lateral spacing between said tubular connector formations to cause said posts to assume a resiliently flexed position when said cross-rail member and said base have been assembled to said posts.

17. The traffic marker of claim 16 wherein the resilient flexing of said posts in said assembled position functions to normally frictionally retain said posts in said aperture means of said base.

18. The traffic marker as defined in claim 16 wherein each said aperture means in said tire upper sidewall portion is located radially outwardly from the mean radius of the tire, and said tire including a second pair of aperture means in said tire lower sidewall portion located diametrically across from each other and radially inwardly from the mean radius of the tire, all four of said aperture means being substantially coplanar.

19. The traffic marker as defined in claim 16, wherein at least two cross-rail members are provided between said posts, the arrangement such that the tubular connector portions of adjacent cross-rail members are located in end-abutting stacked relation on their associated post, whereby said cross-rail members are maintained in uniform horizontally disposed, vertically spaced relation.

20. A traffic marker comprising:

a base adapted to provide lateral stability to resist tipping of the marker from its normally upright position, and provided with a pair of laterally spaced aperture means each extending along a generally vertical axis;

a pair of substantially vertical semi-rigid but resiliently flexible plastic tubular posts, the lower end portions of each of said posts being received in one of said pair of aperture means;

a cross structural member provided with a pair of laterally spaced vertically extending tubular-like connector formations, each of said connector formations being adapted to telescopically slide over one of said posts so that said member extends generally horizontally between said posts;

the orientation and lateral spacing between said aperture means being selected to coact with the lateral spacing between said connector formations to cause said posts to assume a resiliently flexed position when said cross structural member and said base have been telescopically assembled to said posts, the resilient flexing of said posts in said assembled condition functioning to normally frictionally retain said connector formations thereon.

21. The traffic marker of claim 20 wherein the resilient flexing of said posts in said assembled position functions to normally frictionally retain said posts in said aperture means of said base.

22. The traffic marker of claim 20 wherein the lateral spacing between said connector formations is less than the lateral spacing between said aperture means, whereby the assembled condition of said posts with said cross structural member and said base causes said posts to resiliently flex to a position wherein they upwardly converge from said base toward said cross structural member.

23. The traffic marker of claim 22 which further comprises a substantially rigid top cross member interconnecting the upper ends of said posts, the length of said top cross member being selected to maintain a lateral spacing between the upper ends of said posts which is greater than the lateral spacing between said connector formations, whereby the assembled condition of said posts with said top cross member and said cross structural member causes said posts to resiliently flex to a position wherein they upwardly diverge from said cross structural member toward said top cross member.

24. A traffic marker comprising:

a base adapted to provide lateral stability to resist tipping of the marker from its normally upright position, and provided with a pair of laterally spaced aperture means each extending along a generally vertical axis;

a pair of substantially vertical semi-rigid but resiliently flexible plastic tubular posts, the lower end portions of each of said posts being received in one of said pair of aperture means;

a flexible banner provided with connector means at its ends for connection to each of said posts so that said banner extends horizontally therebetween, the length of said banner being selected to coact with the orientation and lateral spacing between said aperture means to cause said banner to resiliently flex said posts toward each other when assembled to said banner and said base.

25. The traffic marker of claim 24 which further comprises a second flexible banner provided with connector means at its ends which function and coact with said posts and said aperture means in the same manner as said first described flexible banner, said first and second banners being vertically spaced from each other along said posts, and a substantially rigid cross rail interconnecting the upper end portions of said posts above said banners and holding said upper end portions apart against the forces applied to said posts by said banners.

26. The traffic marker of claim 25 wherein said connector means comprise hem-like sleeves formed in the ends of said banners and adapted to be telescopically assembled over said posts, the dimensions of said rigid cross rail and said banners and the orientation and lateral spacing between said aperture means coacting to cause said posts to converge upwardly from said base to the lowermost banner and to diverge upwardly from the uppermost of said banners to said rigid cross rail, the resilient flexing and non-parallelism of said posts functioning to frictionally retain said banners in position along said posts and to frictionally retain said posts in said aperture means.

* * * * *